US010406664B2

(12) United States Patent
Zhang et al.

(10) Patent No.: US 10,406,664 B2
(45) Date of Patent: Sep. 10, 2019

(54) IMPACT STRUCTURE

(71) Applicant: Best Achieve Industrial Limited, Dongguan (CN)

(72) Inventors: Jiande Zhang, Dongguan (CN); Hsi-Jen Jen, Dongguan (CN); Yi-Tung Chiu, Dongguan (CN)

(73) Assignee: BEST ACHIEVE INDUSTRIAL LIMITED, Dongguan (CN)

( * ) Notice: Subject to any disclaimer, the term of this patent is extended or adjusted under 35 U.S.C. 154(b) by 246 days.

(21) Appl. No.: 15/591,859

(22) Filed: May 10, 2017

(65) Prior Publication Data

US 2018/0104804 A1 Apr. 19, 2018

(30) Foreign Application Priority Data

Oct. 19, 2016 (CN) ..... 2016 2 1134495 U

(51) Int. Cl.
*B25C 1/04* (2006.01)
*B25C 1/06* (2006.01)

(52) U.S. Cl.
CPC ..... *B25C 1/047* (2013.01); *B25C 1/06* (2013.01)

(58) Field of Classification Search
CPC .. B25C 1/06; B25C 1/188; B25F 5/02; B25D 2250/121
USPC ..... 173/90, 93, 48, 122, 170, 216, 217, 128; 227/156, 131, 147, 130
See application file for complete search history.

(56) References Cited

U.S. PATENT DOCUMENTS 3,486,569 A * 12/1969 Sieber ..... B25B 21/02 173/93.5
5,025,869 A * 6/1991 Terunuma ..... B25D 11/04 173/104
5,443,196 A * 8/1995 Burlington ..... B25C 1/06 173/124
2009/0045241 A1* 2/2009 Fukinuki ..... B25C 1/06 227/131

* cited by examiner

*Primary Examiner* — Nathaniel C Chukwurah
(74) *Attorney, Agent, or Firm* — Sinorica, LLC

(57) ABSTRACT

The present invention relates to the technical field of power-driven hammers, and more specifically, to an impact structure, which comprises a connecting shaft with two ends connected to first bearings and second bearings, wherein the shaft is sleeved around a control disc whose one end-face is connected to gears and the other end-face connected to a striking disc having keys along its circumference, a first stop ring around the shaft and a second stop ring around the shaft are provided respectively between the control disc and the first bearings and between the striking disc and the second bearings, and a spring is provided between the second stop ring and the striking disc; the present invention reciprocates by meshing between the control disc's driving teeth and the striking disc's driven teeth and under the spring's action in operation, effectively avoiding being stuck fast to ensure uninterrupted striking of nails.

5 Claims, 3 Drawing Sheets

IMPACT STRUCTURE

BACKGROUND OF THE INVENTION

Technical Field

The present invention relates to the technical field of power-driven hammers, and more specifically, to an impact structure.

Description of Related Art

A power-driven hammer is a common hand tool and comes in a wide variety. Power-driven hammers can be divided into two categories, i.e. pneumatic hammers and electric hammers, depending on the power source. The pneumatic hammer must be provided with a compressed air source, so its application is limited. The basic construction of the electric hammer is summarized to that: the motor arranged in the gun body is linked with the nail-hitting rod arranged in the gun head through the rotary-linear motion transmission mechanism so that electrical energy can be converted into reciprocating motion under the control of a switch.

The impact structure of a power-driven hammer in the prior art comprises a connecting shaft, a gear-disc, a control part and a striking part, wherein the connecting shaft is connected to the gear-disc, the gear-disc is connected to the control part, the connecting shaft, the control part and the gear-disc are made into one body, the control part is correspondingly connected to the striking part, the control part is uniformly made with three slide grooves, the striking part is made with three slide grooves on its inner wall, and balls are provided between the slide grooves of the control part and the slide grooves of the striking part; in use, gears drive the gear-disc to make the striking part strike nails repeatedly. When such an impact structure strikes nails, the transmission between the control part and the striking part is realized by means of slide grooves and balls, so the striking part and the control part are easily stuck fast in operation for a long time.

BRIEF SUMMARY OF THE INVENTION

The aim of the present invention is to provide an impact structure which is free from being stuck fast to ensure uninterrupted impact, so as to solve the existing problems.

An impact structure comprises a connecting shaft, two ends of which are connected to first bearings and second bearings, the connecting shaft matches with and is sleeved around a control disc, one end-face of which matches with and is connected to gears and the other end-face of which matches with and is connected to a striking disc, the striking disc is made with striking keys along the circumference, a first stop ring is provided between the control disc and the first bearings and clamped around the connecting shaft, a second stop ring is provided between the striking disc and the second bearings and clamped around the connecting shaft, and a spring is provided between the second stop ring and the striking disc.

Wherein, one end-face of the control disc is made with beveled teeth that match and mesh with gears, the other end-face of the control disc is made with at least two driving teeth, a driving tooth space is made between two adjacent driving teeth, the end-face of the striking disc which matches with and is connected to the control disc is made with two driven teeth that match and mesh with the two driving teeth, a driven tooth space is made between two adjacent driven teeth, the driving teeth extend into the driven tooth spaces and the driven teeth extend into the driving tooth spaces.

Wherein, the sides of the driving teeth and the driven teeth are a long curved face and a short curved face respectively, and a short flat face is made between the long curved face and the short curved face.

Wherein, the end-face of the striking disc connected to the spring is made with a mounting groove for accommodating one end of the spring, a mounting plate is provided in the mounting groove, and several balls are provided between the mounting groove and the mounting plate.

Wherein, a gasket is provided between the spring and the second stop ring.

The present invention has the following beneficial effects: it comprises a connecting shaft, two ends of which are connected to first bearings and second bearings, the connecting shaft matches with and is sleeved around a control disc, one end-face of which matches with and is connected to gears and the other end-face of which matches with and is connected to a striking disc, the striking disc is made with striking keys along the circumference, a first stop ring is provided between the control disc and the first bearings and clamped around the connecting shaft, a second stop ring is provided between the striking disc and the second bearings and clamped around the connecting shaft, and a spring is provided between the second stop ring and the striking disc; in the present invention, the control disc and the striking disc are respectively connected as an individual with the connecting shaft, so the hammer reciprocates by the matching and meshing between the driving teeth of the control disc and the driven teeth of the striking disc and under the action of the spring during operation, which can effectively avoid being stuck fast to ensure uninterrupted impact and achieve the aim of driving nails.

DETAILED DESCRIPTION OF THE INVENTION

The present invention will be further detailed hereinafter and accompanied by the embodiments and drawings.

Figure 1:
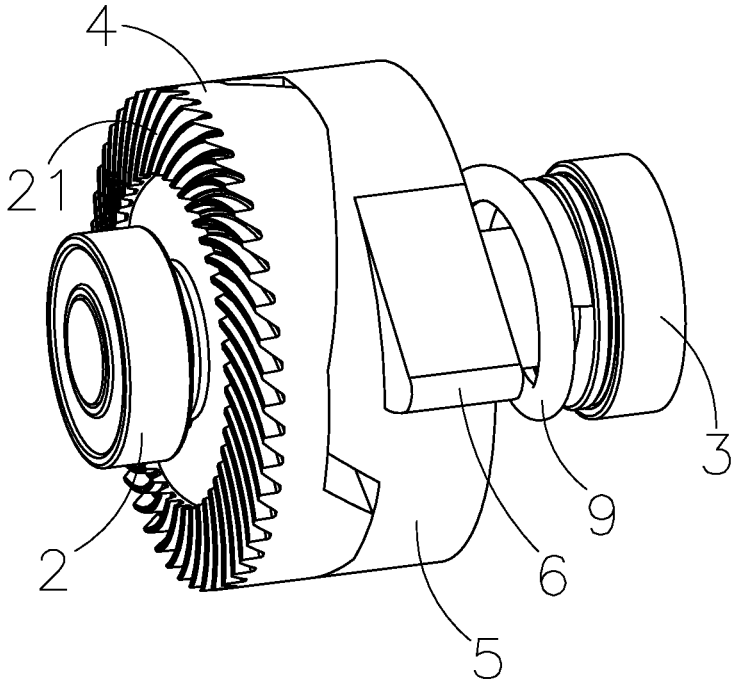
FIG. 1 is a structural diagram of the present invention.
Figure 2:
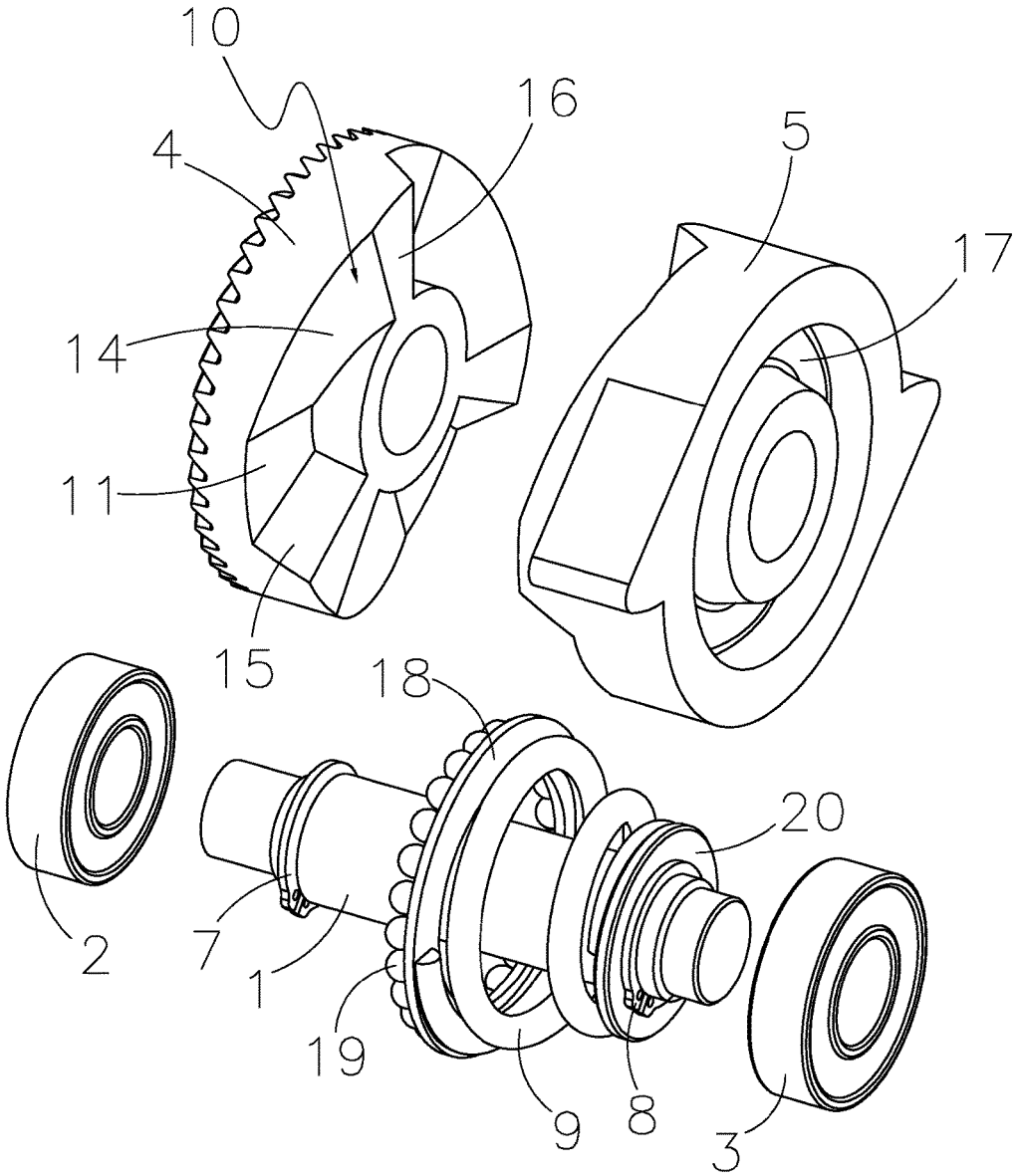
FIG. 2 is a diagram of an exploded structure of the present invention.
Figure 3:
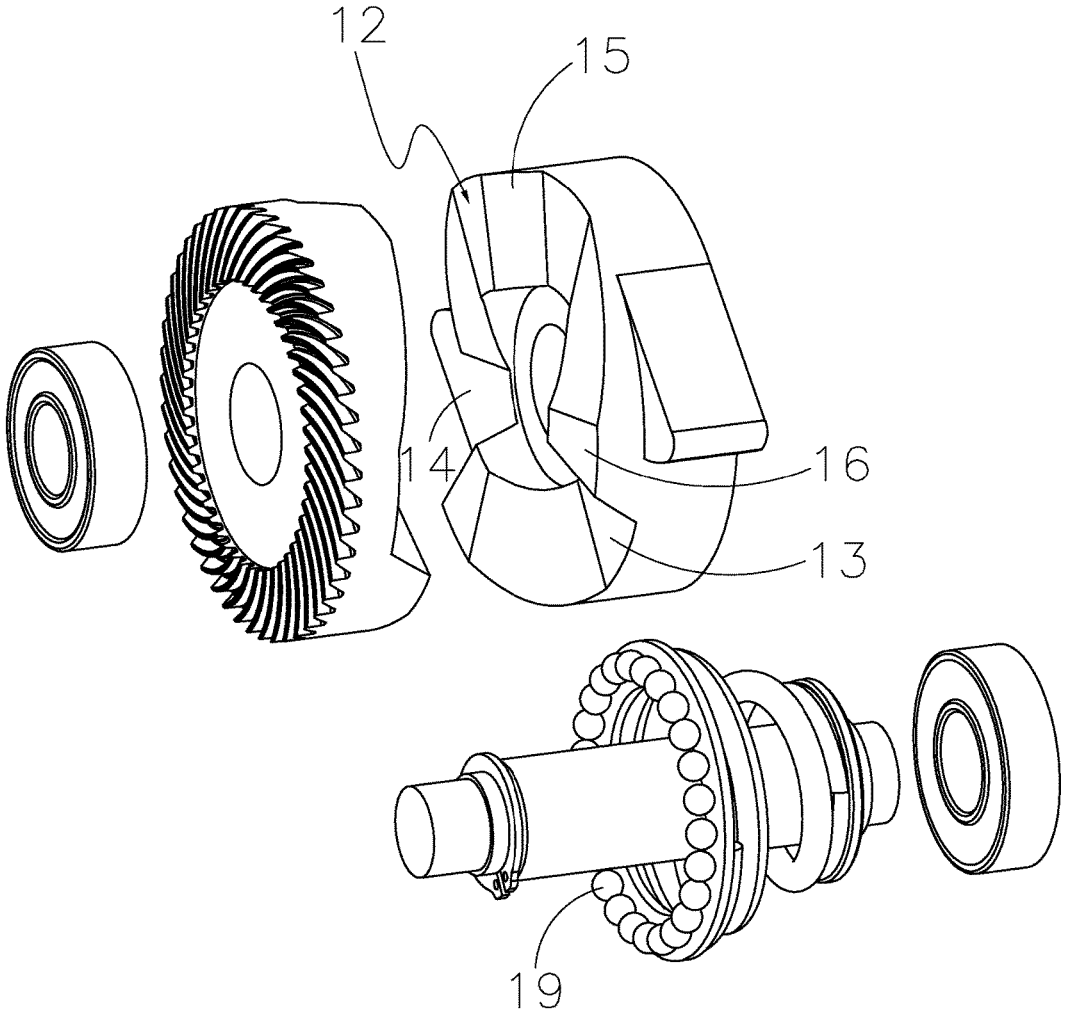
FIG. 3 is another diagram of an exploded structure of the present invention.

As shown in FIG. 1-3, an impact structure comprises a connecting shaft 1, two ends of which are connected to first bearings 2 and second bearings 3, the connecting shaft 1 matches with and is sleeved around a control disc 4, one end-face of which matches with and is connected to gears and the other end-face of which matches with and is connected to a striking disc 5, the striking disc 5 is made with striking keys 6 along the circumference, a first stop ring 7 is provided between the control disc 4 and the first bearings 2 and clamped around the connecting shaft 1, a second stop ring 8 is provided between the striking disc 5 and the second bearings 3 and clamped around the connecting shaft 1, wherein the first stop ring 7 and the second stop ring 8 are disconnected at the lower part and made with two holes respectively so that a split pin can secure the first stop ring 7 and the second stop ring 8 permanently on the connecting shaft 1 in use, and a spring 9 is provided between the second stop ring 8 and the striking disc 5; in the present invention, the control disc 4 and the striking disc 5 are respectively connected as an individual with the connecting shaft 1, so the hammer reciprocates by the matching and meshing between the driving teeth 10 of the control disc 4 and the driven teeth 12 of the striking disc 5 and under the action of the spring 9 in operation, which can effectively avoid being stuck fast to ensure uninterrupted impact and achieve the aim of driving nails.

In the embodiment, one end-face of the control disc 4 is made with beveled teeth 21 that match and mesh with gears, the other end-face of the control disc 4 is made with at least two driving teeth 10, a driving tooth space 11 is made between two adjacent driving teeth 10, the end-face of the striking disc 5 which matches with and is connected to the control disc 4 is made with two driven teeth 12 that match and mesh with the two driving teeth 10, a driven tooth space 13 is made between two adjacent driven teeth 12, the driving teeth 10 extend into the driven tooth spaces 13 and the driven teeth 12 extend into the driving tooth spaces 11; in operation, the gears mesh with the beveled teeth 21 to drive the control disc 4, the driving teeth 10 of the control disc 4 drives the driven teeth 12 to rotate the striking disc 5, and the striking keys 6 of the striking disc 5 reciprocates to strike nails under the action of the spring 9.

In the embodiment, the sides of the driving teeth 10 and the driven teeth 12 are a long curved face 14 and a short curved face 15 respectively, and a short flat face 16 is made between the long curved face 14 and the short curved face 15, wherein the long curved face 14 and the short curved face 15 are used to rotate the control disc 4 and the striking disc 5, and the short flat face 16 is used to bring the control disc 4 in close contact with the striking disc 5.

The operating principle of the present invention is as below: the gears mesh with the beveled teeth 21 to drive the control disc 4, and the long curved faces 14 of the driving teeth 10 of the control disc 4 drive and mesh with the long curved faces 14 of the driven teeth 12; during the slide from the lowest point of the long curved face 14 to the highest point, the striking disc 5 is driven to rotate so that the striking keys 6 strike nails, and meanwhile, moves rightward to compress the spring 9; after finishing the slide from the lowest point of the long curved face 14 to the highest point as the long curved faces 14 of the driving teeth 10 drive and mesh with the long curved faces 14 of the driven teeth 12, sliding from the highest point of the long curved face 14 to the lowest point occurs under the action of the spring 9, which meshes the striking disc 5 and the control disc 4; and that cycle repeats to achieve the aim of driving nails.

In the embodiment, the end-face of the striking disc 5 connected to the spring 9 is made with a mounting groove 17 for accommodating one end of the spring 9, a mounting plate 18 is provided in the mounting groove 17, several balls 19 are provided between the mounting groove 17 and the mounting plate 18; one end of the striking disc 5 is made with a mounting groove 17 and a mounting plate 18 is provided in the mounting groove 17 in order to facilitate mounting of the spring 9, and several balls 19 are provided between the mounting groove 17 and the mounting plate 18 in order to facilitate the rotation of the striking disc 5 upon mounting of the spring 9 and not to affect the use of the spring 9.

In the embodiment, a gasket 20 is provided between the spring 9 and the second stop ring 8, and the diameter of the gasket 20 is greater than that of the second stop ring 8 to provide protection against failure of the spring 9.

The foregoing is an embodiment of the present invention, but the structural features of the present invention are not limited thereto. All alternations or modifications of the present invention made by those skilled in this art are within the patent scope of the present invention.

What is claimed is:

1. An impact structure, characterized in that it comprises a connecting shaft, two ends of which are connected to first bearings and second bearings, the connecting shaft matches with and is sleeved around a control disc, one end-face of which matches with and is connected to gears and the other end-face of which matches with and is connected to a striking disc, the striking disc is made with striking keys along the circumference, a first stop ring is provided between the control disc and the first bearings and clamped around the connecting shaft, a second stop ring is provided between the striking disc and the second bearings and clamped around the connecting shaft, and a spring is provided between the second stop ring and the striking disc.

2. The impact structure as claimed in claim 1, characterized in that one end-face of the control disc is made with beveled teeth that match and mesh with gears, the other end-face of the control disc is made with at least two driving teeth, a driving tooth space is made between two adjacent driving teeth, the end-face of the striking disc which matches with and is connected to the control disc is made with two driven teeth that match and mesh with the two driving teeth, a driven tooth space is made between two adjacent driven teeth, the driving teeth extend into the driven tooth spaces and the driven teeth extend into the driving tooth spaces.

3. The impact structure as claimed in claim 1, characterized in that the sides of the driving teeth and the driven teeth are a long curved face and a short curved face respectively, and a short flat face is made between the long curved face and the short curved face.

4. The impact structure as claimed in claim 1, characterized in that the end-face of the striking disc connected to the spring is made with a mounting groove for accommodating one end of the spring, a mounting plate is provided in the mounting groove, and several balls are provided between the mounting groove and the mounting plate.

5. The impact structure as claimed in claim 1, characterized in that a gasket is provided between the spring and the second stop ring.

* * * * *